US007637396B2

(12) United States Patent
Foster et al.

(10) Patent No.: US 7,637,396 B2
(45) Date of Patent: Dec. 29, 2009

(54) TRIGGER SPRAYER PISTON ROD WITH INTEGRAL SPRING AND BALL AND SOCKET PISTON CONNECTION

(75) Inventors: Donald D. Foster, St. Charles, MO (US); Jeffrey P. Stark, Wentzville, MO (US)

(73) Assignee: MeadWestvaco Clamar, Inc., Grandview, MO (US)

( * ) Notice: Subject to any disclaimer, the term of this patent is extended or adjusted under 35 U.S.C. 154(b) by 387 days.

(21) Appl. No.: 11/549,858

(22) Filed: Oct. 16, 2006

(65) Prior Publication Data

US 2007/0215647 A1 Sep. 20, 2007

Related U.S. Application Data

(63) Continuation-in-part of application No. 11/376,071, filed on Mar. 15, 2006, now Pat. No. 7,497,358.

(51) Int. Cl.
*B65D 88/54* (2006.01)

(52) U.S. Cl. ..... 222/340; 222/383.1

(58) Field of Classification Search ..... 222/340, 222/136, 383.1, 336, 381, 382; 329/333
See application file for complete search history.

(56) References Cited

U.S. PATENT DOCUMENTS

| | | | | |
|---|---|---|---|---|
| 1,401,075 | A | | 12/1921 | Hartwig |
| 3,854,557 | A | | 12/1974 | Wilcox |
| 4,624,413 | A | * | 11/1986 | Corsette ..... 239/333 |
| 4,973,309 | A | * | 11/1990 | Sultan ..... 604/110 |
| 5,181,912 | A | * | 1/1993 | Hammett ..... 604/110 |
| 5,297,701 | A | | 3/1994 | Steijns et al. |
| 5,318,206 | A | | 6/1994 | Maas et al. |
| 5,332,128 | A | | 7/1994 | Mass et al. |
| 5,553,752 | A | | 9/1996 | Foster et al. |
| 5,706,984 | A | | 1/1998 | Tada et al. |
| 5,964,377 | A | * | 10/1999 | Demarest et al. ..... 222/136 |
| 5,984,149 | A | * | 11/1999 | Thanisch et al. ..... 222/340 |
| 6,116,472 | A | * | 9/2000 | Wanbaugh et al. ..... 222/340 |
| 7,175,056 | B2 | | 2/2007 | Buti |
| 7,311,227 | B2 | | 12/2007 | Foster |
| 2004/0222243 | A1 | | 11/2004 | Sweeton |
| 2006/0076434 | A1 | | 4/2006 | Hornsby et al. |

FOREIGN PATENT DOCUMENTS

| | | | | |
|---|---|---|---|---|
| JP | 9-314001 | * | 12/1997 | ..... 222/340 |

* cited by examiner

*Primary Examiner*—Lien T Ngo

(57) ABSTRACT

A manually operated trigger sprayer is constructed with a reduced number of parts and in a novel manner in which the conventional metal coil spring is replaced with a pair of plastic bowed springs that are integral with the piston rod and the pump piston is connected to the piston rod by a ball and socket connection.

15 Claims, 6 Drawing Sheets

TRIGGER SPRAYER PISTON ROD WITH INTEGRAL SPRING AND BALL AND SOCKET PISTON CONNECTION

This patent application is a continuation-in-part of patent application Ser. No. 11/376,071, which was filed on Mar. 15, 2006, and now U.S. Pat. No. 7,497,358.

BACKGROUND OF THE INVENTION (1) Field of the Invention

The present invention pertains to the construction of a manually operated trigger sprayer in which the conventional metal coil spring is replaced with a plastic spring that is an integral part of the pump piston rod and the pump piston is connected to the piston rod by a ball and socket connection.

(2) Description of the Related Art

Handheld and hand pumped liquid dispensers commonly known as trigger sprayers are used to dispense many household products and commercial cleaners. Trigger sprayers have been designed to selectively dispense the liquids in a spray, stream, or foaming discharge. The trigger sprayer is typically connected to a plastic bottle that contains the liquid dispensed by the sprayer.

A typical trigger sprayer includes a sprayer housing that is connected to the neck of the bottle by either a screw thread connection or a bayonet-type connection. The sprayer housing is formed with a pump chamber and a vent chamber, a liquid supply passage that communicates the pump chamber with a liquid inlet opening of the sprayer housing, and a liquid discharge passage that communicates the pump chamber with a liquid outlet opening of the sprayer housing. A dip tube is connected to the sprayer housing liquid inlet opening to communicate the pump chamber with the liquid contents of the bottle connected to the trigger sprayer.

A nozzle assembly is connected to the sprayer housing at the liquid outlet opening. Some nozzle assemblies include a nozzle cap that is rotatable relative to the sprayer housing between an "off" position where liquid discharge from the trigger sprayer is prevented, and one or more "on" positions where liquid discharge from the trigger sprayer is permitted. In addition, known nozzle assemblies can affect the liquid discharged by the trigger sprayer to discharge the liquid in a spray pattern, in a stream pattern, or as a foam.

A pump piston is mounted in the sprayer housing pump chamber for reciprocating movement between charge and discharge positions of the piston relative to the pump chamber. When the pump piston is moved to its charge position, the piston is retracted out of the pump chamber. This creates a vacuum in the pump chamber that draws liquid from the bottle, through the dip tube and into the pump chamber. When the pump piston is moved to its discharge position, the piston is moved into the pump chamber. This compresses the liquid in the pump chamber and pumps the liquid from the pump chamber, through the liquid discharge passage of the sprayer housing and out of the trigger sprayer through the nozzle assembly.

A metal coil spring is positioned in the pump chamber and engages with the pump piston. The coil spring biases the pump piston to the discharge position of the piston.

A vent piston is often provided with the pump piston and is mounted in the vent chamber. The vent piston moves with the pump piston between a vent closed position and a vent opened position in the vent chamber. In the vent opened position, the interior volume of the bottle attached to the trigger sprayer is vented through the vent chamber to the exterior environment of the trigger sprayer. In the vent closed position, the venting path of air through the vent chamber is closed, preventing leakage of the liquid in the bottle through the venting flow path should the bottle and trigger sprayer be inverted or positioned on their sides.

A trigger is mounted on the sprayer housing for movement of the trigger relative to the trigger sprayer. The trigger is operatively connected to the pump piston to cause the reciprocating movement of the pump piston in the pump chamber in response to movement of the trigger. A user's hand squeezes the trigger toward the sprayer housing to move the trigger and move the pump piston toward the discharge position of the piston in the pump chamber. The metal coil spring in the pump chamber pushes the piston back to the discharge position of the piston relative to the pump chamber when the user's squeezing force on the trigger is released.

Inlet and outlet check valves are assembled into the respective liquid supply passage and liquid discharge passage of the trigger sprayer. The check valves control the flow of liquid from the bottle interior volume through the liquid supply passage and into the pump chamber, and then from the pump chamber and through the liquid discharge passage to the nozzle assembly of the trigger sprayer.

The typical construction of the trigger sprayer discussed above has several separate component parts. The manufacturing of each of these individual component parts contributes to the overall cost of manufacturing the trigger sprayer. Because trigger sprayers are manufactured and sold in very large numbers, even a slight reduction in the manufacturing costs of a trigger sprayer can result in a significant overall reduction in the cost of manufacturing a large number of trigger sprayers. As a result, pistons with integral plastic springs have been designed to eliminate the metal coil springs used in conventional trigger sprayers and to reduce the number of component parts of the trigger sprayers. However, it has been observed that with the spring integrally connected to the piston, on reciprocation of the piston in the liquid pump chamber, the spring will exert force components on the piston that will tend to move the piston away from its coaxially aligned position relative to the pump chamber. This could distort the sealing engagement of the piston in the pump chamber and cause liquid to leak from the pump chamber on reciprocating movements of the piston.

SUMMARY OF THE INVENTION

The trigger sprayer of the present invention overcomes the disadvantages associated with prior art trigger sprayers having integral spring and piston designs by providing an integral spring and piston rod with a connection between the piston rod and a pump piston that allows the pump piston to move relative to the piston rod. As a result, force components exerted by the spring on the integral piston rod are isolated from the piston and do not affect the sealing engagement between the piston and pump chamber as the piston is reciprocated in the pump chamber. This eliminates the problem of liquid leaking from the pump chamber in trigger sprayers having integral spring and piston assemblies.

The trigger sprayer of the invention has a sprayer housing construction that is similar to that of prior art trigger sprayers. The sprayer housing basically includes an integral cap that attaches to the neck of a separate bottle that contains the liquid to be dispensed by the trigger sprayer. A liquid inlet opening is provided on the sprayer housing inside the cap, and a liquid supply passage extends upwardly through the sprayer housing from the liquid inlet opening.

The sprayer housing also includes a pump chamber having a cylindrical pump chamber wall. The pump chamber communicates with the liquid supply passage.

A liquid discharge passage extends through a liquid discharge tube on the sprayer housing. The liquid discharge passage communicates the pump chamber with a liquid outlet opening on the sprayer housing.

A valve assembly is inserted into the liquid supply passage and separates the liquid supply passage from the liquid discharge passage. The valve assembly includes an input valve that controls the flow of liquid from the sprayer housing inlet opening to the pump chamber, and an output valve that controls the flow of liquid from the pump chamber and through the liquid discharge passage to the liquid outlet opening.

A valve plug assembly is assembled into the liquid supply passage of the sprayer housing. The valve plug assembly includes a valve seat that seats against the input valve, and a vent baffle that defines a vent air flow path through the pump chamber to the interior of the bottle attached to the trigger sprayer.

A nozzle assembly is assembled to the trigger sprayer at the sprayer housing liquid outlet opening. The nozzle assembly is rotatable relative to the trigger sprayer to close the liquid flow path through the liquid discharge passage and the liquid outlet opening, and to open the liquid flow path through the liquid discharge passage and the outlet opening. The nozzle assembly has several open positions relative to the sprayer housing that enable the selective discharge of a liquid in a stream pattern, a spray pattern, and a foaming discharge.

A piston assembly is mounted in the pump chamber for reciprocating movements between charge and discharge positions of the piston assembly relative to the sprayer housing. The piston assembly includes a pump piston and a vent piston both mounted in the pump chamber. As the pump piston moves to its charge position, the vent piston is moved to a closed position where a venting air flow path through the pump chamber and through the venting air baffle is closed. As the pump piston is moved to its discharge position, the vent piston is moved to an open position in the pump chamber. This opens the venting air flow path through the pump chamber and the venting air baffle to the interior volume of the bottle attached to the trigger sprayer.

A manually operated trigger is mounted on the sprayer housing for pivoting movement. The trigger is engaged by the fingers of a user's hand holding the trigger sprayer. Squeezing the trigger causes the trigger to move toward the pump chamber, and releasing the squeezing force on the trigger allows the trigger to move away from the pump chamber.

The novel construction of the trigger sprayer of the invention includes a piston rod that is operatively connected between the trigger and the pump piston. The piston rod has a length with opposite first and second ends, with the first end engaging with the trigger and the second end being connected to the pump piston.

The novel construction of the trigger sprayer also includes a pair of springs that are formed integrally with the piston rod. The pair of springs and the piston rod are one monolithic piece of plastic material. The pair of springs each have a length with opposite proximal and distal ends. The length of each spring is curved or formed in a bowed configuration. The proximal end of each spring is connected to the piston rod. From the proximal ends of the springs, the springs extend away from the piston rod and curve over the exterior of the pump chamber wall. The lengths of the springs extend across opposite sides of the sprayer housing discharge tube as the springs extend from the piston rod. As the spring lengths extend along opposite sides of the discharge tube, the spring lengths then curve back toward the pump chamber of the sprayer housing. The spring lengths cantilever from the piston rod. The distal ends of the springs engage against the sprayer housing and are the only portions of the springs to engage with the sprayer housing.

The liquid piston is connected to the piston rod by a ball and socket connection. The piston rod has an arm that projects from the rod to a ball or sphere of the connection. A socket is formed inside the piston by five circumferentially spaced webs having curved surfaces. The curved surfaces on the webs engage in sliding engagement against opposite sides of the piston rod ball in connecting the piston on the piston rod. The connection enables the piston to pivot freely about the center axis of the piston rod. This enables the piston rod to reciprocate the piston in the pump chamber, without transmitting any radially directed force components from the spring to the piston.

The springs bias the piston rod and the pump piston away from the pump chamber. This biases the pump piston toward its charge position relative to the pump chamber and the sprayer housing. By manually squeezing the trigger of the trigger sprayer, the proximal ends of the springs are moved toward the distal ends of the springs, increasing the curvature of the bowed springs. When the squeezing force on the trigger is removed, the resiliency of the springs pushes the trigger away from the pump chamber and moves the pump piston back to its charge position relative to the pump chamber.

By providing the bowed springs as an integral part of the pump piston rod in lieu of the conventional coiled metal spring positioned in the pump chamber, the component parts of the trigger sprayer are reduced. This results in reduced manufacturing costs. By providing the ball and socket connection between the piston rod and the pump piston, any radial force components caused by the compression and extension of the springs are isolated in the piston rod and do not act on the piston. In this way, the sealing engagement of the piston in the pump chamber is maintained as the piston is reciprocated through the pump chamber.

In addition, by providing the pair of springs as an integral part of the pump piston rod, the springs are constructed of the same piece of material as the pump piston rod. This eliminates the need for a metal coil spring and enables all of the component parts of the trigger sprayer to be constructed of plastic material. With all of the sprayer parts being constructed of plastic, the trigger sprayer can be recycled more economically.

DESCRIPTION OF THE DRAWING FIGURES

Further features of the invention are set forth in the following detailed description of the preferred embodiment of the invention and in the drawing figures wherein.

DETAILED DESCRIPTION OF THE PREFERRED EMBODIMENT

Figure 1:
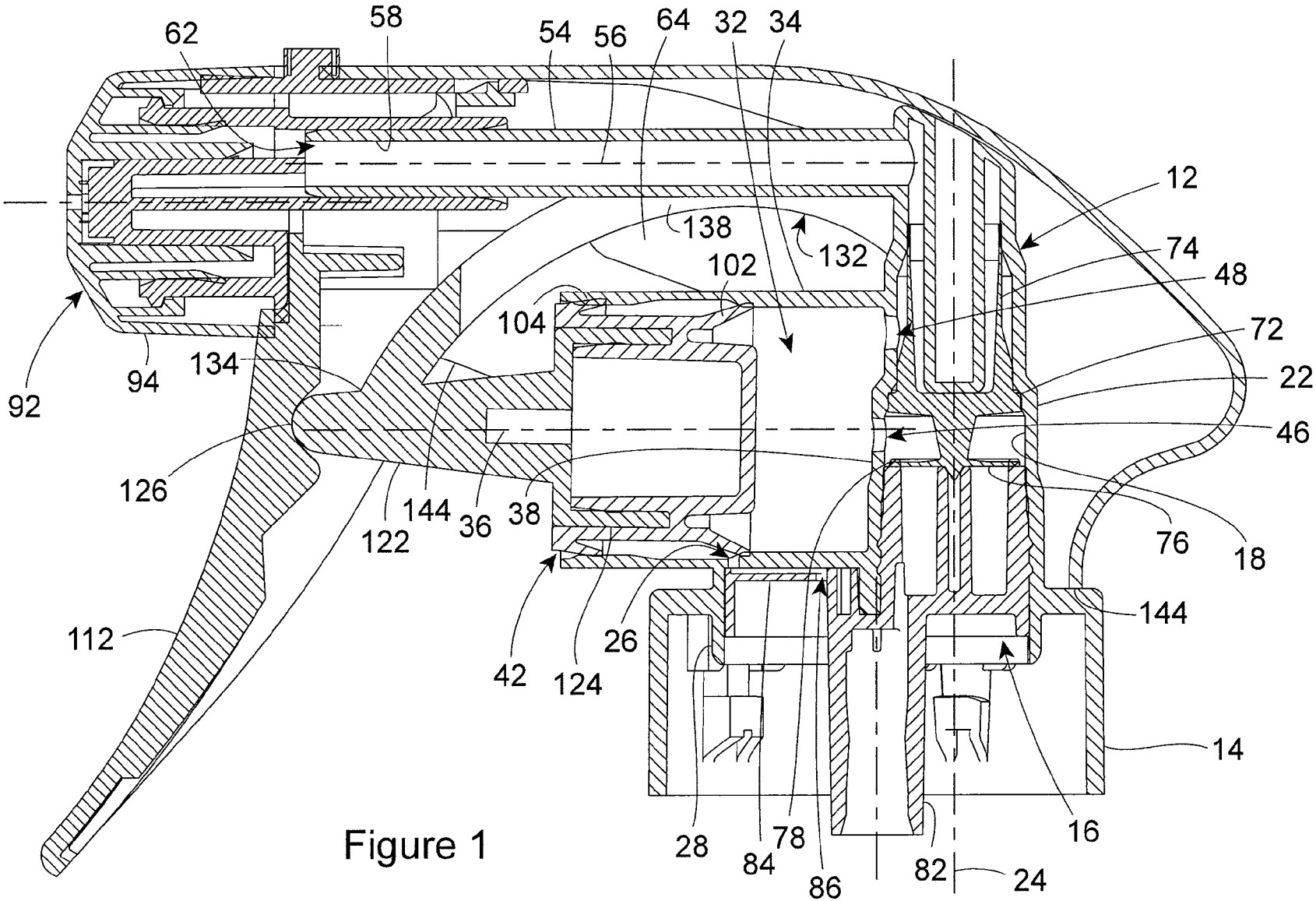
FIG. 1 is a side sectioned view of the trigger sprayer of the invention with the trigger in a forward position relative to the sprayer housing.
Figure 2:
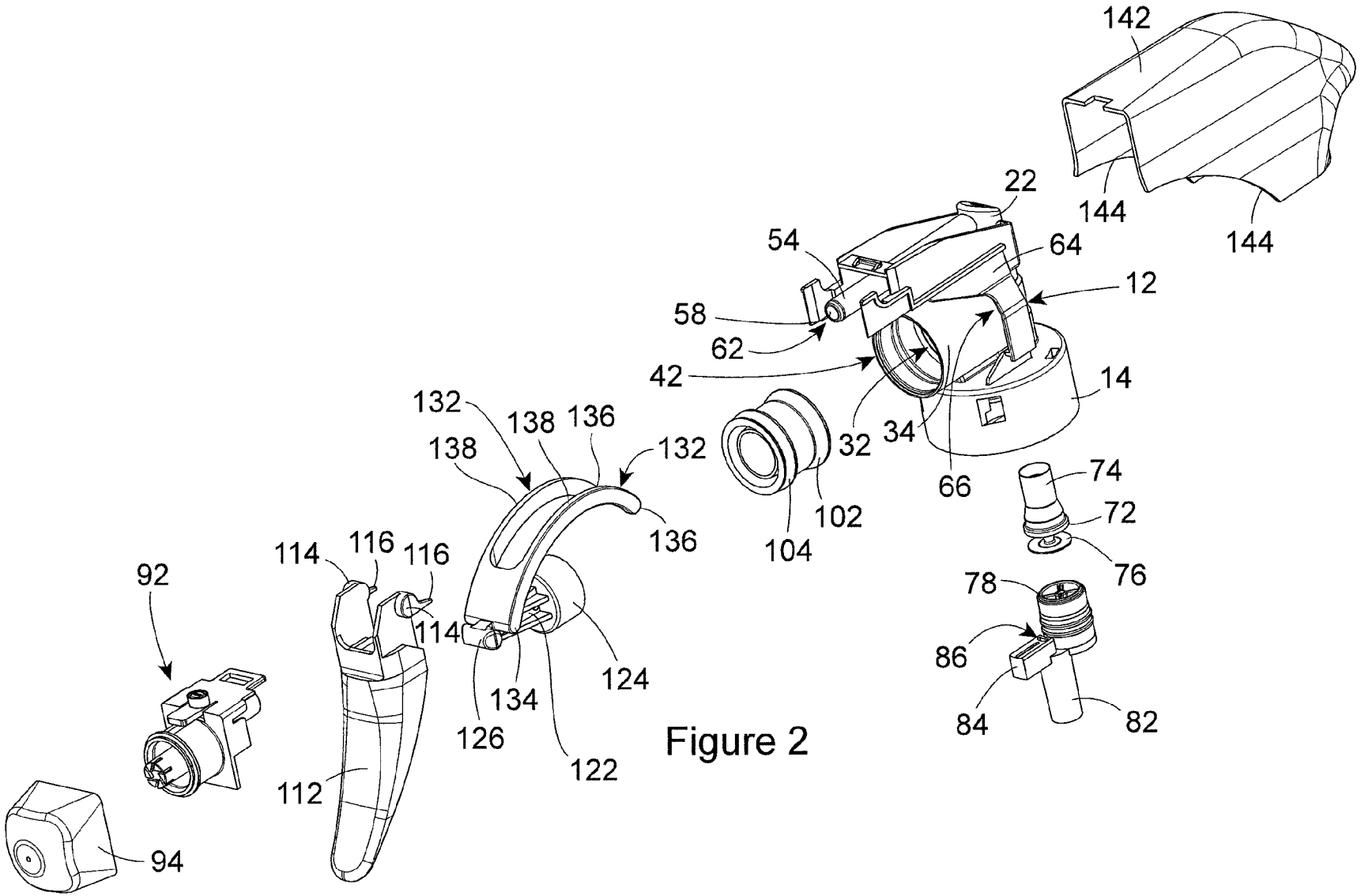
FIG. 2 is a perspective view of the disassembled component parts of the trigger sprayer.
Figure 3:
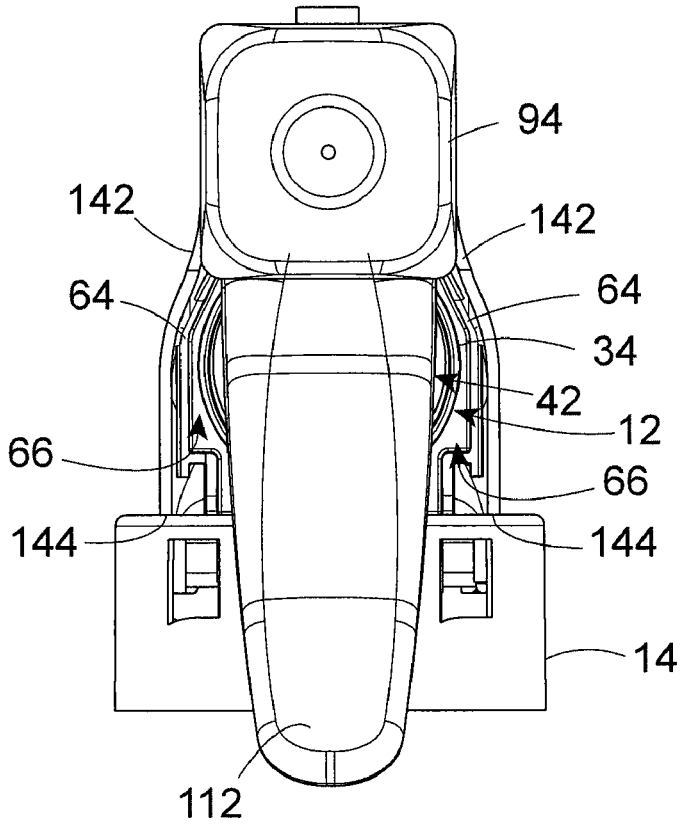
FIG. 3 is a front view of the trigger sprayer.
Figure 4:
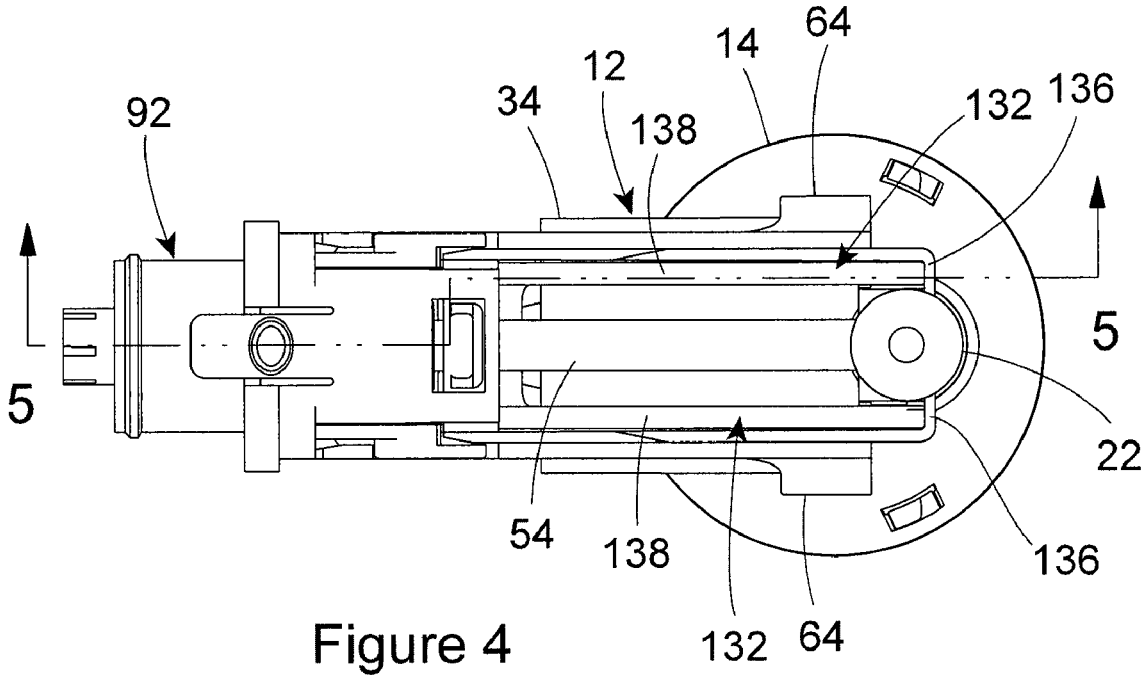
FIG. 4 is a top view of the trigger sprayer with the shroud removed.
Figure 5:
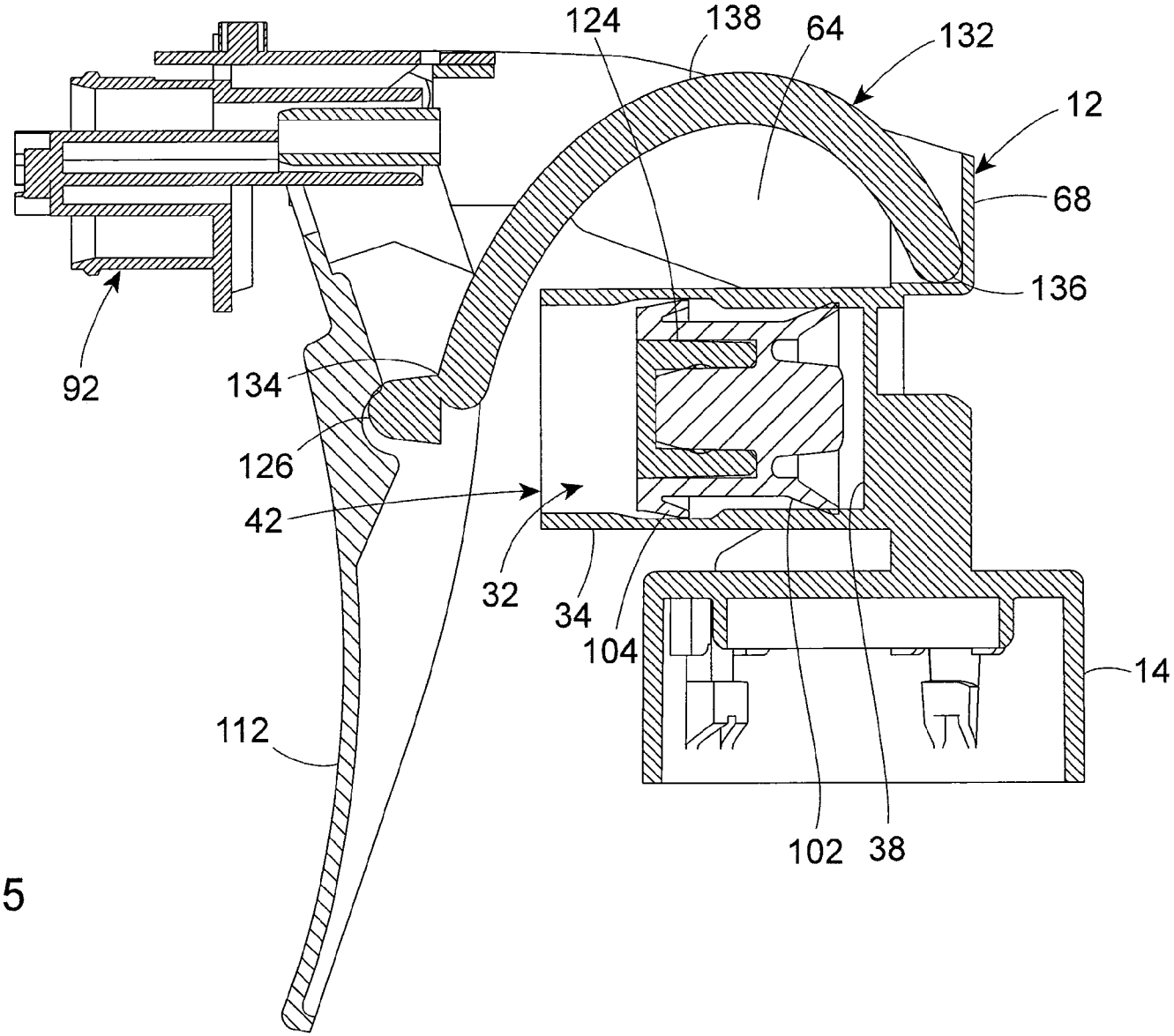
FIG. 5 is a side sectioned view of the trigger sprayer along the line 5-5 of FIG. 4 and with the trigger in a rearward position relative to the sprayer housing.

As stated earlier, the novel design of the trigger sprayer of the present invention enables each of the component parts of the trigger sprayer to be constructed of a resilient, plastic material. In addition, the novel construction enables several component parts to be constructed of one, monolithic piece of material, that were in the past constructed of several separate pieces. This results in a reduction in the manufacturing costs. The all plastic construction of the trigger sprayer enables the sprayer to be more economically recycled after use. In addition, the pump piston is connected to the piston rod by a ball and socket connection that enables the piston to stay axially aligned with the pump chamber as the piston reciprocates in the pump chamber.

Several component parts of the trigger sprayer are found in the typical construction of a trigger sprayer, and therefore these component parts are described only generally herein. It should be understood that although the component parts are shown in the drawing figures and are described as having a certain construction, other equivalent constructions of the component parts are known. These other equivalent constructions of trigger sprayer component parts are equally well suited for use with the novel features of the invention to be described herein.

The trigger sprayer includes a sprayer housing 12 that is formed integrally with a connector cap 14. The connector cap 14 removably attaches the trigger sprayer to the neck of a bottle containing the liquid to be dispensed by the trigger sprayer. The connector cap 14 shown in the drawing figures has a bayonet-type connector on its interior. Other types of equivalent connectors may be employed in attaching the trigger sprayer to a bottle. A liquid inlet opening 16 is provided on the sprayer housing 12 in the interior of the connector cap 14. The inlet opening 16 provides access to a liquid supply passage 18 that extends upwardly through a cylindrical liquid column 22 formed in the sprayer housing 12. The column 22 has a center axis 24 that is also the center axis of the liquid supply passage 18. An air vent opening 26 is also provided on the sprayer housing 12 in the interior of the connector cap 14. A cylindrical sealing rim 28 projects outwardly from the connector cap interior and extends around the liquid inlet opening 16 and the vent opening 26. The rim 28 engages inside the neck of a bottle connected to the trigger sprayer to seal the connection.

The sprayer housing includes a pump chamber 32 contained inside a cylindrical pump chamber wall 34 on the sprayer housing 12. The pump chamber cylindrical wall 34 has a center axis 36 that is perpendicular to the liquid supply passage center axis 24. The interior surface of the pump chamber wall 34 has a smaller interior diameter section adjacent a rear wall 38 of the pump chamber, and a larger interior diameter section adjacent an end opening 42 of the pump chamber. The smaller interior diameter portion of the pump chamber 32 functions as the liquid pump chamber, and the larger interior diameter portion of the pump chamber 32 functions as a portion of a venting air flow path through the sprayer housing 12. The vent opening 26 in the sprayer housing connector cap 14 communicates the interior of the larger interior diameter portion of the pump chamber 32 with a bottle connected to the trigger sprayer. A pair of openings 46, 48 pass through the pump chamber rear wall 38 and communicate the interior of the pump chamber with the liquid supply passage 18. The first of the openings 46 is the liquid input opening to the pump chamber 32, and the second of the openings 48 is the liquid output opening from the pump chamber.

A liquid discharge tube 54 is also formed on the sprayer housing 12. The liquid discharge tube is cylindrical and has a center axis 56 that is parallel with the pump chamber center axis 36. The liquid discharge tube 54 defines the liquid discharge passage 58 of the sprayer housing. One end of the liquid discharge passage 58 communicates with the liquid supply passage 18 in the liquid column 22, and the opposite end of the liquid discharge passage 58 exits the sprayer housing 12 through a liquid outlet opening 62 on the sprayer housing.

The sprayer housing 12 is also formed with a pair of exterior side walls or side panels 64 that extend over opposite sides of the pump chamber wall 34 and over opposite sides of the discharge tube 54. The side walls 64 extend over the pump chamber wall 34 in the area of the pump chamber rear wall 38, but do not extend in the forward direction the full extent of the pump chamber wall 34 to the end opening 42. The side walls 64 are spaced outwardly from the pump chamber wall 34 and the discharge tube 54 forming voids 66 between the side wall 64 and the pump chamber wall 34 and the discharge tube 54. The side walls 64 have lengths on the opposite sides of the liquid discharge tube 54 that extend substantially the entire length of the discharge tube. Rear walls 68 of the sprayer housing 12 extend outwardly from opposite sides of the liquid column 22 and connect to the rearward edges of the side walls 64.

A valve assembly comprising an intermediate plug 72, a resilient sleeve valve 74 and a resilient disk valve 76 is assembled into the liquid supply passage 18. The valve assembly is inserted through the liquid inlet opening 16 and the valve assembly plug 72 seats tightly in the liquid supply passage 18 between the pump chamber input opening 46 and the pump chamber output opening 48. Thus, the plug 72 separates the liquid inlet opening 16 into the pump chamber 32 from the liquid outlet opening 62 from the pump chamber 32. The disk valve 76 is positioned in the liquid supply passage 18 to control the flow of liquid from the liquid inlet opening 16 into the pump chamber 32, and to prevent the reverse flow of liquid. The sleeve valve 74 is positioned to control the flow of liquid from the pump chamber 32 and through the liquid discharge passage 58 and the liquid outlet opening 62, and to prevent the reverse flow of liquid.

A valve plug assembly comprising a valve seat 78, a dip tube connector 82, and an air vent baffle 84 is assembled into the liquid inlet opening 16 inside the connector cap 14. The valve seat 78 is cylindrical and seats against the outer perimeter of the valve assembly disk valve 76. A hollow interior bore of the valve seat 78 allows liquid to flow through the bore and unseat the disk valve 76 from the seat 78 as the liquid flows from the inlet opening 16 to the pump chamber 32. The periphery of the disk valve 76 seats against the valve seat 78 to prevent the reverse flow of liquid. The dip tube connector 82 is a cylindrical connector at the center of the plug assembly that connects to a separate dip tube (not shown). The valve plug assembly positions the dip tube connector 82 so that it is centered in the connector cap 14 of the sprayer housing. The air vent baffle 84 covers over but is spaced from the vent opening 26 in the connector cap 14. The baffle 84 has a baffle opening 86 that is not aligned with the vent opening 26, but communicates with the vent opening through the spacing between the air vent baffle 84 and the interior surface of the connector cap 14. This allows air to pass through the vent opening 26 and through the baffle spacing and the baffle opening 86 to vent the interior of the bottle connected to the trigger sprayer to the exterior environment of the sprayer. Because the vent opening 26 and baffle opening 86 are not directly aligned, the air vent baffle 84 prevents liquid in the bottle from inadvertently passing through the baffle opening 86, the baffle spacing and the vent opening 26 to the exterior of the trigger sprayer should the trigger sprayer and bottle be inverted or positioned on their sides.

A nozzle assembly 92 is assembled to the sprayer housing 12 at the liquid outlet opening 62. The nozzle assembly 92 can have the construction of any conventional known nozzle assembly that produces the desired discharge pattern of liquid from the trigger sprayer. In the preferred embodiment of the invention, the nozzle assembly 92 has a rotatable nozzle cap 94 that selectively changes the discharge from a "off" condition where the discharge is prevented, to a "spray" condition, a "stream" condition and/or a foaming discharge.

A piston assembly comprising a liquid pump piston 102 and a vent piston 104 is mounted in the pump chamber 32 for reciprocating movement along the pump chamber axis 36. The pump piston 102 reciprocates between a charge position and a discharge position in the pump chamber 32. In the charge position, the pump piston 102 moves in a forward direction away from the pump chamber rear wall 38. This expands the interior of the pump chamber creating a vacuum in the chamber that draws liquid into the pump chamber, as is conventional. In the discharge position, the pump piston 102 moves in an opposite rearward direction into the pump chamber toward the pump chamber rear wall 38. This compresses the liquid drawn into the pump chamber 32 and forces the liquid through the output opening 48, past the sleeve valve 74 and through the liquid discharge passage 58 and the liquid outlet opening 62. As the pump piston 102 reciprocates in the pump chamber 32 between the charge and discharge positions, the vent piston 104 reciprocates between a vent closed position where the vent piston 104 engages against the interior surface of the pump chamber wall 34, and a vent open position where the vent piston 104 is spaced inwardly from the interior of the pump chamber wall 34. In the vent open position of the vent piston 104, air from the exterior environment of the sprayer can pass through the pump chamber opening 42, past the vent piston 104 to the vent opening 26, and then through the spacing between the baffle 84 and the connector cap 14, through the vent baffle opening 86 and to the interior of the bottle connected to the trigger sprayer.

A manually operated trigger 112 is mounted on the sprayer housing 12 for movement of the trigger relative to the sprayer housing. The trigger 112 has a pair of pivot posts 114 that project from opposite sides of the trigger and mount the trigger to the sprayer housing 12 for pivoting movement. A pair of abutments 116 project outwardly from the pivot posts 114 and limit the pivoting movement of the trigger 112 toward the sprayer housing 12. The construction of the trigger includes a finger engagement surface that is engaged by the fingers of a user's hand. Squeezing the trigger causes the trigger to pivot rearwardly toward the pump chamber 32, and releasing the squeezing force on the trigger allows the trigger to pivot forwardly away from the pump chamber.

The novel construction of the trigger sprayer of the invention includes a piston rod 122 that is operatively connected between the trigger 112 and the pump piston 102 and vent piston 104. The piston rod 122 has a length with a cylindrical collar 124 at one end of the rod length. The cylindrical collar 124 is assembled to the pump piston 102 and vent piston 104. The opposite end 126 of the piston rod 122 engages with and is operatively connected to the trigger 112.

The novel construction of the trigger sprayer also includes a pair of springs 132 that are formed integrally with the piston rod 122. Together the springs 132 and the piston rod 122 are one, monolithic piece of plastic material, thereby reducing the number of separate component parts that go into the construction of the trigger sprayer. The pair of springs 132 each have a narrow, elongate length that extends between opposite proximal 134 and distal 136 ends of the springs. The intermediate portions 138 of the springs between the proximal ends 134 and distal ends 136 have the same, curved or bowed configuration. The spring proximal ends 134 are connected to the piston rod 122 intermediate the opposite ends 124, 126 of the piston rod. From the proximal ends 134, the lengths of the springs curve upwardly away from the piston rod 122 and the pump chamber center axis 36 through the intermediate portions 138 of the springs. As the lengths of the springs continue along the spring intermediate portions 138, the springs extend along opposite sides of the liquid discharge tube 154 and over the pump chamber wall 34. The springs then extend downwardly toward the pump chamber center axis 36 as the springs extend to their distal ends 136. Each of the springs 132 is cantilevered from the piston rod 122 from the spring proximal ends 134, with the spring distal ends 136 being free ends. The spring distal ends 136 engage against the sprayer housing rear walls 68, with the spring distal ends 136 being the only portions of the springs that engage with the sprayer housing 12.

The bowed or curved configurations of the springs 132 bias the piston rod 122 and the connected pump piston 102 and vent piston 104 outwardly away from the pump chamber rear wall 38. This biases the pump piston 102 toward its charge position relative to the pump chamber 32 and the sprayer housing 12. By manually squeezing the trigger 112, the spring proximal ends 134 move toward the spring distal ends 136, increasing the curvature of the bowed intermediate portions 138 of the springs. When the squeezing force on the trigger 112 is removed, the resiliency of the springs pushes the trigger 112 away from the pump chamber rear wall 38 and moves the pump piston 102 back to its charge position relative to the pump chamber 32.

A shroud 142 is attached over the sprayer housing 12 to provide an aesthetically pleasing appearance to the trigger sprayer. The shroud 142 has a lower edge 144 that is positioned below the pair of springs 132. Thus, the shroud 142 protects the springs 132 from contact with portions of the hand or other objects exterior to the trigger sprayer when the trigger sprayer is being operated.

By providing the bowed springs 132 as an integral part of the pump piston rod 122 in lieu of the conventional coiled metal spring positioned in the pump chamber, the component parts of the trigger sprayer are reduced. This results in reduced manufacturing costs for the trigger sprayer.

In addition, by providing the pair of springs 132 as an integral part of the pump piston rod 122, the springs are constructed of the same piece of material as the pump piston rod. This eliminates the need for a separate metal coil spring and enables all of the component parts of the trigger sprayer to be constructed of a plastic material. With all the sprayer parts being constructed of plastic, the trigger sprayer can be recycled more economically after use.

Figure 6:
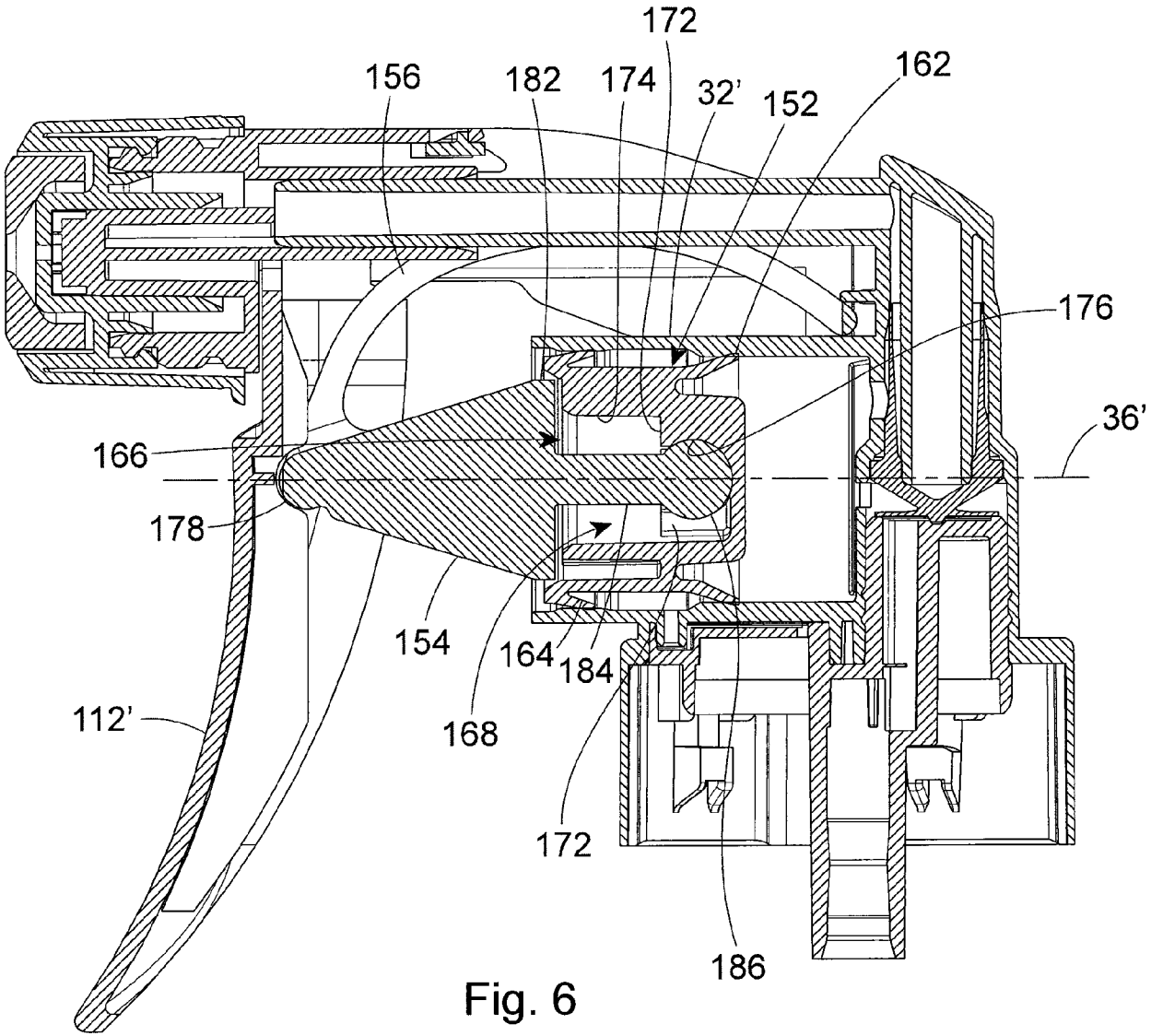
FIG. 6 is a side-sectioned view of the trigger sprayer similar to that of FIG. 1, but showing the piston rod with an integral spring and a ball and socket connection with the piston; and, FIG. 7 is a perspective view of the piston rod and piston of FIG. 6 removed from the trigger sprayer, with the piston shown in cross-section.
Figure 7:
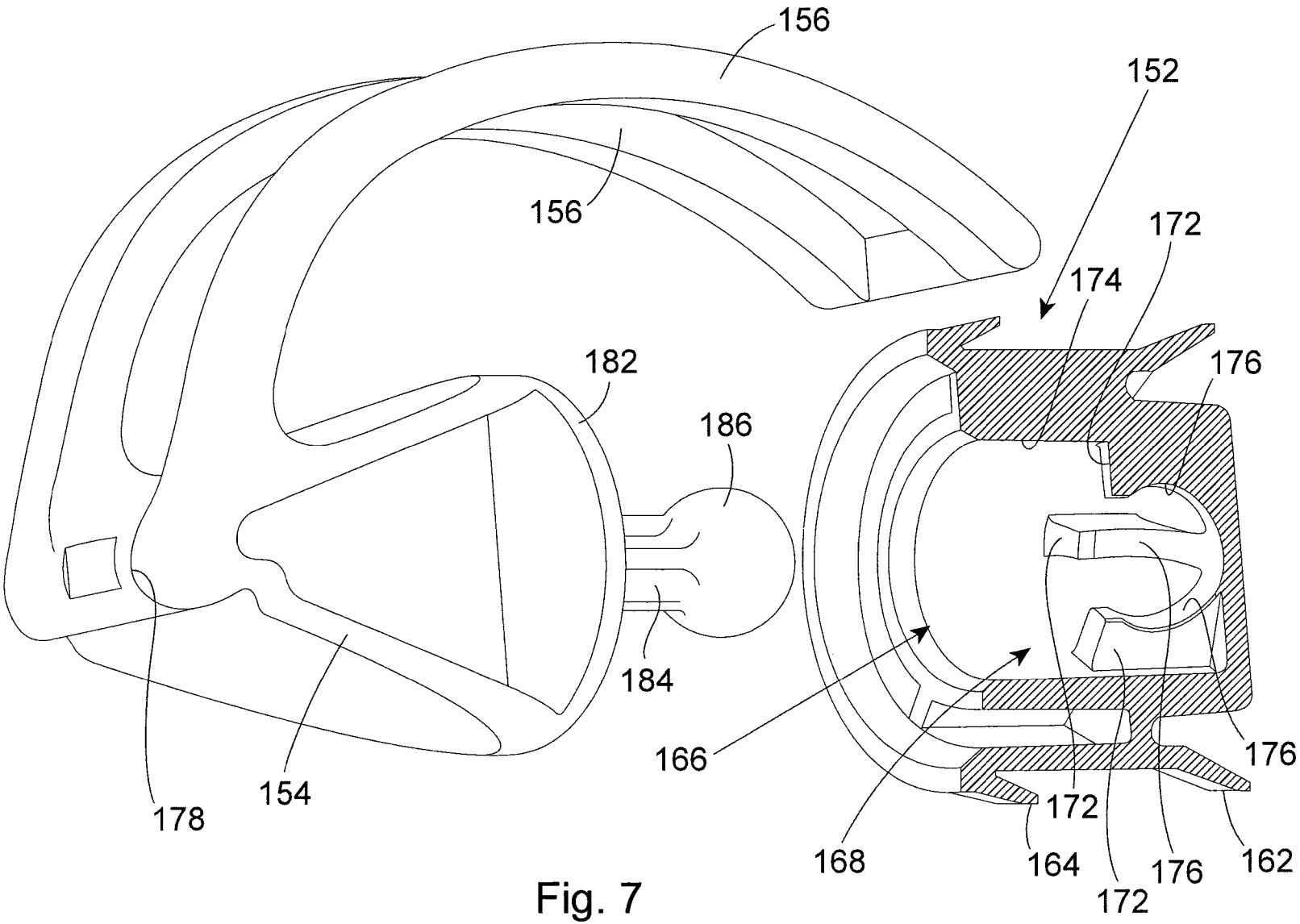

FIGS. 6 and 7 show a further embodiment trigger sprayer piston assembly 152, piston rod 154, and spring pair 156 of the invention. The trigger sprayer shown in FIGS. 6 and 7 has substantially the same construction as that shown in FIGS. 1-5. Therefore, some of the reference number labeling of the component parts of the trigger sprayer shown in FIGS. 6 and 7 is the same as that shown in FIGS. 1-5, but the reference numbers in FIGS. 6 and 7 are followed by a prime (').Because the construction of the trigger sprayer shown in FIGS. 6 and 7 is substantially the same as that shown in FIGS. 1-5, the trigger sprayer construction will not be again described. Only the component parts of the trigger sprayer shown in FIGS. 6 and 7 that differ from those of FIGS. 1-5 will be described. These component parts basically include the piston assembly 152, the piston rod 154, and the spring pair 156.

As in the earlier described embodiment, the piston assembly 152 is comprised of a liquid pump piston 162 and a vent piston 164. These pistons are mounted in the pump chamber 32' for reciprocating movements along the pump chamber axis 36'. As in the previously described embodiment, the pump piston 162 reciprocates in the pump chamber 32' to pump liquid through the trigger sprayer. As the pump piston 162 reciprocates in the pump chamber 32' between the charge and discharge positions, the vent piston 164 reciprocates between a vent closed position and a vent opened position in the same manner as the previously described embodiment of the trigger sprayer. The piston assembly 152 differs from that of the previously described embodiment in that it is provided with a front opening 166 to a hollow interior bore 168 of the piston. A plurality of webs 172 extend radially inwardly from the interior surface 174 of the piston assembly 152 that surrounds the interior bore 168. The webs 172 also extend axially through the rear portion of the piston interior bore 168. Each of the webs 172 has a concave curved surface 176 at its radially inward end. The curved surfaces 176 of the webs 172 are spaced from and spacially arranged around the center axis of the piston assembly 152 and the pump chamber 36'. Together, the plurality of the web curved surfaces 176 define a socket connection in the interior of the piston assembly 152. In the preferred embodiment of the piston assembly 152 shown in the drawing figures, there are five webs 172 spacially arranged around the pump chamber center axis 36'.

The piston rod 154 is operatively connected between the trigger 112' and the piston assembly 152. A forward end 178 of the piston rod 154 engages with and is operatively connected to the trigger 112'. A circular radial flange 182 is positioned on an intermediate portion of the piston rod 154. The flange 182 is dimensioned to fit in the front opening 166 of the piston assembly 152. The flange 182 has a diameter dimension that is slightly smaller than a diameter dimension of the pump piston front opening 166, which allows the piston assembly 152 to move in a limited pivoting motion relative to the piston rod 154. The pivoting motion of the piston assembly 152 is limited by engagement of the piston assembly 152 with the flange 182. In this manner, the flange 182 provides a covering over the piston front opening 166 while allowing limited pivoting movement of the piston assembly 152 relative to the flange 182 and the piston rod 154.

A center post 184 extends axially rearwardly from the center of the circular flange 182. The post 184 extends rearwardly along the pump chamber center axis 36' to a sphere or ball 186 formed on a distal end of the post. The ball 186 is dimensioned to be snap fit in the socket defined by the curved surfaces 176 of the piston assembly webs 172. Snap fitting the ball 186 into the curved surfaces 176 of the webs 172 provides a ball and socket connection between the piston rod 154 and the piston assembly 152 that allows the piston assembly 152 to pivot in all directions about the pump chamber center axis 36'.

The novel construction of the piston rod 154 also includes the pair of springs 156 that are integrally formed with the piston rod 154. Together, the springs 156 and the piston rod 154 are one, monolithic piece of plastic material. The springs 156 have the same constructions and function in the same manner as the pair of springs 132 of the earlier-described embodiment.

In the operation of the trigger sprayer, it was observed that the pair of springs 156 being integrally formed with the piston rod 154 would produce a radially directed force component as the trigger 112' is squeezed and released and the piston assembly 152 is reciprocated in the pump chamber 32'. The ball and socket connection provided by the piston rod ball 186 and the curved web surfaces 176 of the piston assembly 152 isolate the radial force components to the piston rod 154 and prevent the transfer of the radial force components to the piston assembly 152. This prevents the radial force components from acting on the piston assembly 152 which could potentially distort the axially aligned position of the piston assembly 152 in the pump chamber 32' and produce leakage of liquid from the pump chamber. Due to the ball and socket connection provided by the piston rod ball 186 and the piston web curved surfaces 176, the forces exerted on the piston assembly 152 due to manual manipulation of the trigger 112' are basically axially aligned with the pump chamber center axis 36'.

Although the trigger sprayer of the invention has been described above by reference to specific embodiments, it should be understood that modifications and variations could be made to the trigger sprayer without departing from the intended scope of the following claims.

The invention claimed is:

1. A manually operated trigger sprayer comprising:
a sprayer housing comprising a pump chamber;
a trigger mounted on the sprayer housing;
a piston assembly mounted in the pump chamber;
a piston rod operatively connected to the trigger wherein a forward end of the piston rod engages with the trigger;
a ball on an end of the piston rod opposite the trigger; and,
a plurality of axially extending curved surfaces on the piston assembly that engage around the ball and hold the piston assembly on the ball by forming a ball and socket connection between the piston rod and the piston assembly.

2. A manually operated trigger sprayer comprising:
a sprayer housing comprising a pump chamber;
a trigger mounted on the sprayer housing;
a piston assembly mounted in the pump chamber;
a piston rod operatively connected to the trigger, wherein a forward end of the piston rod engages with the trigger;
a ball and socket connection between the piston rod and the piston assembly,
a ball on an end of the piston rod opposite the trigger;
the piston assembly comprising a socket, the socket receiving the ball and providing the ball and socket connection between the piston rod and the piston assembly;
the piston assembly comprising a hollow interior bore that extends axially into the piston assembly from an opening in the piston assembly, the socket being positioned in the bore at an opposite end of the bore from the opening; and,
a plurality of webs in the bore, the plurality of webs extending radially in the bore to curved surfaces on the webs, the curved surfaces defining the socket and engaging with the ball.

3. A manually operated trigger sprayer comprising:
a sprayer housing comprising a pump chamber;
a trigger mounted on the sprayer housing;
a piston rod operatively connected to the trigger, wherein a forward end of the piston rod engages with the trigger;

a piston assembly mounted in the pump chamber;

a ball and socket connection between the piston rod and the piston assembly;

a ball on an end of the piston rod opposite the trigger;

the piston assembly comprising a socket, the socket receiving the ball and providing the ball and socket connection between the piston rod and the piston assembly;

the piston assembly comprising a hollow interior bore that extends axially into the piston assembly from an opening in the piston assembly, the socket being positioned in the bore at an opposite end of the bore from the opening; and, the piston rod comprising a flange projecting radially from an intermediate portion of the piston rod, the flange covering over the opening.

4. The trigger sprayer of claim 3, wherein the piston rod further comprises an arm that extends axially from the flange, the ball being on an opposite end of the arm from the flange.

5. trigger sprayer of claim 4, further comprising:

a spring integral with the piston rod and extending between the piston rod and the sprayer housing.

6. The trigger sprayer of claim 5, wherein the spring further comprises a narrow, elongate curved length with opposite proximal and distal ends, the spring proximal end is integrally connected to the piston rod and the spring comprising a length that extends from the spring proximal end outside the pump chamber to the spring distal end.

7. A manually operated trigger sprayer comprising:

a sprayer housing comprising a pump chamber;

a trigger mounted on the sprayer housing;

a piston rod operatively connected to the trigger, wherein a forward end of the piston rod engages with the trigger;

a ball on an end of the piston rod that is opposite the trigger;

a spring comprising a length with opposite proximal and distal ends, wherein the spring proximal end is operatively connected to the piston rod with the spring length extending from the proximal end and the piston rod to the spring distal end;

a piston assembly mounted in the pump chamber; and, a plurality of radially extending webs on the piston assembly, the plurality of webs comprising curved surfaces that oppose each other and engage around the ball forming a ball and socket connection between the piston rod and the piston assembly.

8. The trigger sprayer of claim 7, wherein the spring further comprises a curved length that extends from the spring proximal end outside of the pump chamber to the spring distal end.

9. The trigger sprayer of claim 7, wherein the spring is one of a pair of springs integrally connected to the piston rod, each spring comprises a proximal end integrally connected to the piston rod and each spring comprises a length extending from the proximal end away from the piston rod to a distal end of the spring.

10. A manually operated trigger sprayer comprising:

a sprayer housing comprising a pump chamber;

a trigger mounted on the sprayer housing;

a piston rod operatively connected to the trigger, wherein a forward end of the piston rod engages with the trigger;

a spring comprising a length with opposite proximal and distal ends, wherein the spring proximal end is connected to the piston rod with the spring length extending from the proximal end and the piston rod to the spring distal end;

a piston assembly mounted in the pump chamber;

a ball and socket connection between the piston rod and the piston assembly;

the spring comprising a curved length that extends from the spring proximal end outside of the pump chamber to the spring distal end;

wherein the spring is one of a pair of springs integrally connected to the piston rod, each spring comprising a proximal end integrally connected to the piston rod and each spring comprising a length extending from the proximal end away from the piston rod to a distal end of the spring;

a ball on an end of the piston rod opposite the trigger;

the piston assembly comprising a socket, the socket receiving the ball and providing the ball and socket connection between the piston rod and the piston assembly;

a hollow interior bore that extends axially into the piston assembly from an opening in the piston assembly to the socket at an opposite end of the bore from the opening;

at least one curved surface inside the bore at an opposite end of the bore from the opening, the at least one curved surface engaging with the ball and providing the ball and socket connection between the piston rod and the piston assembly; and wherein, the at least one curved surface is one of a plurality of separate curved surfaces spatially arranged around the pump chamber center axis in the bore, the plurality of curved surfaces engaging around the ball and providing the ball and socket connection between the piston rod and the piston assembly.

11. A manually operated trigger sprayer comprising:

a sprayer housing comprising a pump chamber;

a trigger mounted on the sprayer housing;

a piston rod operatively connected to the trigger, wherein a forward end of the piston rod engages with the trigger;

a spring comprising a length with opposite proximal and distal ends, wherein the spring proximal end is connected to the piston rod with the spring length extending from the proximal end and the piston rod to the spring distal end;

a piston assembly mounted in the pump chamber;

a ball and socket connection between the piston rod and the piston assembly;

the spring comprising a curved length that extends from the spring proximal end outside of the pump chamber to the spring distal end;

wherein the spring is one of a pair of springs integrally connected to the piston rod, each spring comprising a proximal end integrally connected to the piston rod and each spring comprising a length extending from the proximal end away from the piston rod to a distal end of the spring;

a ball on an end of the piston rod opposite the trigger;

the piston assembly comprising a socket, the socket receiving the ball and providing the ball and socket connection between the piston rod and the piston assembly;

a hollow interior bore that extends axially into the piston assembly from an opening in the piston assembly to the socket at an opposite end of the bore from the opening; and, a plurality of webs in the bore, the plurality of webs extending radially in the bore to curved surfaces on the webs, the curved surfaces defining the socket and engaging with the ball.

12. The trigger sprayer of claim 11, wherein the piston rod comprises a flange projecting radially from an intermediate portion of the piston rod, the flange covering over the opening.

13. The trigger sprayer of claim 12, wherein the piston rod comprises an arm that extends axially from the flange, the ball being on an opposite end of the arm from the flange.

14. A manually operated trigger sprayer comprising:

a sprayer housing comprising a cylindrical pump chamber wall containing a pump chamber;

a trigger mounted on the sprayer housing;

a piston rod comprising an axial length with opposite forward and rearward ends, the piston rod forward end engaging with and being operatively connected to the trigger;

a ball on the rearward end of the piston rod;

a piston assembly mounted in the pump chamber, the piston assembly comprising a hollow interior bore extending axially into the piston assembly from a bore opening at an end of the piston assembly adjacent the piston rod, the piston assembly comprising at least one curved surface inside the bore at an opposite end of the bore from the bore opening, the at least one curved surface engaging with the ball and providing a ball and socket connection between the piston rod and the piston assembly; and, the piston assembly comprising a plurality of curved surfaces in the bore and positioned on opposite sides of the pump chamber, the at least one curved surface being one of the plurality of curved surfaces, and the plurality of curved surface engaging with the ball and providing the ball and socket connection between the ball and the piston assembly.

15. The trigger sprayer of claim 14, further comprising:

the piston assembly comprising a plurality of webs that extend radially into the bore to the plurality of curved surfaces on the plurality of webs, the plurality of webs being spatially arranged around the pump chamber.

* * * * *